US006138898A

United States Patent [19]

Will et al.

[11] Patent Number: 6,138,898

[45] Date of Patent: Oct. 31, 2000

[54] CORNER GAP WELD PATTERN FOR SPF CORE PACKS

[75] Inventors: Jeffrey D. Will, Renton; Gary S. Glenn, Burien; Gerould K. Young, Mercer Island, all of Wash.

[73] Assignee: The Boeing Company, Seattle, Wash.

[21] Appl. No.: 09/219,074

[22] Filed: Dec. 22, 1998

[51] Int. Cl.[7] ..... B21D 47/02; B21K 23/00; B23K 20/00; B32B 3/12

[52] U.S. Cl. ..... 228/157; 228/193; 29/421.1; 29/897; 428/178; 52/783.1; 52/793.11

[58] Field of Search ..... 228/157, 193, 228/194, 195, 206, 219; 29/421.1, 897.31, 897.312, 897; 428/178, 593, 594; 52/783.1, 793.1, 793.11

[56] References Cited

U.S. PATENT DOCUMENTS

| | | | |
|---|---|---|---|
| 4,217,397 | 8/1980 | Hayase et al. . | |
| 4,304,821 | 12/1981 | Hayase et al. | 428/593 |
| 4,577,798 | 3/1986 | Rainville | 228/157 |
| 4,658,362 | 4/1987 | Bhatt . | |
| 4,934,580 | 6/1990 | Sutton . | |
| 5,139,887 | 8/1992 | Sutton . | |
| 5,141,146 | 8/1992 | Yasui . | |
| 5,289,965 | 3/1994 | Yasui et al. | 228/157 |
| 5,330,093 | 7/1994 | Bottomley et al. . | |
| 5,366,787 | 11/1994 | Yasui et al. . | |
| 5,603,449 | 2/1997 | Mansbridge et al. | 228/157 |
| 5,715,644 | 2/1998 | Yasui | 52/784.14 |
| 5,723,225 | 3/1998 | Yasui et al. | 428/593 |
| 5,850,722 | 12/1998 | Yasui | 52/793.11 |
| 5,994,666 | 11/1999 | Buldhaupt et al. | 219/121.64 |

*Primary Examiner*—Patrick Ryan
*Assistant Examiner*—Kiley Stoner
*Attorney, Agent, or Firm*—J. Michael Neary

[57] ABSTRACT

A method of making an monolithic metallic sandwich structure includes selecting at least two chemically clean metal core sheets having superplastic characteristics and placing them face-to-face. The core sheets are welded together into a core pack along intersecting lines that will form junction lines of webs defining cells between the core sheets when the core pack is expanded superplastically. Gaps are left adjacent to the intersections of the weld lines to produce openings through which gas can pass to pressurize each cell. The position of the gaps adjacent the weld line intersections minimizes strain on the marginal regions around the openings as the core pack is inflated, to reduce the tendency of the sheets to tear or rupture around the openings. A gas pressure line fitting is inserted between one edge and the core pack is welded around its periphery with the gas fitting protruding from the edge for connection to a gas source that will purge and pressurize the core pack with gas. Two chemically cleaned metal face sheets having superplastic characteristics are placed over and under the core pack, and all four sheets are peripheral seal welded to produce a sealed envelope pack enclosing the core pack, with gas fittings into the core pack and into a face sheet zone between the face sheets and the core pack. Dry Argon is admitted through the gas fittings to purge air and moisture from the packs and then to pressurize the packs to a low pressure to maintain separation of the sheets while heating to prevent premature diffusion bonding. The full pack is placed in an internal cavity of a heated die and is raised to superplastic temperatures. Forming gas is injected through the fittings at a forming pressure sufficient to inflate the envelope pack to the interior walls of the cavity, and inflate the core pack to the envelope pack and to diffusion bond the face sheets to the core sheets. After forming, the die is opened and the formed pack is removed.

20 Claims, 9 Drawing Sheets

CORNER GAP WELD PATTERN FOR SPF CORE PACKS

This invention pertains to multisheet metallic sandwich structures expanded by superplastic forming, and to processes for fabricating such structures using a core pack made up of two or more sheets of superplastic metal welded together in a welding pattern having intersecting weld lines. Corner-gaps are left in the weld lines adjacent intersections of the weld lines for pass-through of forming gas. The pack is expanded in a preheated die using gas under pressure communicating throughout the interior of the core pack via the weld gaps. The corner location of the weld gaps minimizes forming stresses on the sheet metal used in the pack during superplastic forming.

BACKGROUND OF THE INVENTION

Multisheet superplastically formed, diffusion bonded, metallic sandwich structures have been in use for many years, primarily in the aerospace industry, because of low cost, high temperature capability and good strength and stiffness per unit weight. Various processes for fabricating these structures have been developed in the past, with varying degrees of success, but all have proven slow to produce, and often they have high scrap rates. Parts produced by these prior art processes often are capable of only a fraction of the theoretical load-bearing capacity.

Most of the existing techniques for fabricating such structures, including the truss core technique shown in U.S. Pat. No. 3,927,817 to Hamilton, utilize superplastic forming of a stack of sheets in a die having a cavity shaped like the final sandwich structure. The stack includes two or more core sheets that are selectively joined to each other to form a core pack by lines of welding or diffusion bonding and top and bottom sheets that form the top and bottom outside skins of the sandwich structure. The stack is inflated at superplastic temperature with gas pressure to expand the top and bottom sheets outwardly against the interior walls of the die cavity to the desired exterior dimensions. During superplastic forming, the core sheets stretch away from their lines of attachment toward the top and bottom skins as those skins expand toward the boundary surfaces of the die cavity.

Early techniques for fabricating multi-sheet monolithic metal sandwich structures utilized diffusion bonding to join the core sheets along selective areas to produce the desired core structure. These techniques required accurate placement of stop-off to prevent diffusion bonding in areas where adjacent sheets were not intended to be bonded. Diffusion bonds retain superplastic qualities, but it has been difficult to produce a narrow, clean bond line that is free of stop-off. Diffusion bonding often is a lengthy process, requiring long holding times in the press at elevated temperature, preventing use of the press for other production. The capital intensive and time consuming nature of the diffusion bonding process lead to research into other techniques for joining the core sheets of multisheet stack that would be faster, more reliable, and less costly.

Another method, shown in U.S. Pat. Nos. 4,217,397 and 4,304,821 to Hayase et al., produces a metal sandwich structure having top and bottom face sheets and internal webs extending perpendicularly between the face sheets, defining closed cells within the sandwich structure. This method uses intermittent roll seam electric resistance welding of the core sheets along intersecting lines to establish the junction lines between the core sheets and to define the shape of the closed cells. The intermittent welding leaves gaps in the weld lines for passage of forming gas into the cells. This process was faster than the diffusion bonding technique, but still required care to avoid premature diffusion bonding of the core sheets to each other. The pack of sheets could be purged and pressurized to slightly inflate the stack and separate the sheets from one another so that they would not diffusion bond together. The pack of sheets would then be heated to superplastic temperature and forming gas would be admitted under pressure into the pack to expand the top and bottom sheets superplastically against the walls of the die cavity. Gas pressure was also admitted into the core pack to superplastically form the core sheets at the same time outward against the top and bottom sheets and to fold the core sheets over onto themselves about the weld lines to form the desired cellular sandwich structure. Diffusion bonding would occur where the core sheets contacted the face sheets or one another.

Heating titanium to a high temperature in the presence of oxygen creates a surface layer of alpha case, which is a hard but very brittle composition and is unacceptable in structural parts because of its tendency to crack. Such cracks could grow in a fatigue environment and lead to failure of the part. Consequently, it is desirable to purge oxygen and moisture from the stack of sheets before heating to elevated temperatures. In U.S. patent application Ser. No. 09/101,688 entitled "Multisheet Metal Sandwich Structure" by Buldhaupt et al., the stack of sheets is sealed and purged of oxygen and moisture before loading so the sealed pack can be loaded into a hot die without the danger of alpha case forming before the stack is purged and without using expensive press time to purge the stack and then slowly bring the die up to superplastic temperature.

Another technique for welding the sheets in the core pack together, shown in U.S. Pat. No. 4,603,089 to Bampton, uses a $CO_2$ laser to weld sheets in the stack together. An improvement on the Bampton laser welding technique is shown in the Buldhaupt et al. patent application which teaches a practical way to hold the sheets together while they are being laser welded. It presses the sheets into intimate contact during welding to obtain a quality weld, and also protects the weld area from oxidation at high temperature that occurs during laser welding of titanium.

One solution for the problem of excessive thinout in superplastic forming a part having a central hole or opening is a double diaphragm forming technique. This technique achieves increased part thickness in the area of the part at the lip or periphery of the central hole or opening by using a blank having a hole in the area where the opening will be in the part. During forming, the hole in the blank increases in area while reducing stress in the material in the region, thereby reducing thinout in that region. A related disclosure is in U.S. Provisional Application No. 60/088,772 by Peter Smiley which uses slits in the runout area of the blank to reduce forming stresses in the material allowing the material to be drawn into the actual part region of the die, thereby minimizing thinout.

None of these prior techniques recognized the cause of a long-standing problem in the art, namely, the rupturing of the sheets of a core pack around the weld gap during forming of a metallic sandwich structure. When a new part is being developed, it is common for ruptures to occur in the core pack sheets in the region around the weld gap during superplastic forming because of excessive thinning. The forming gas can escape through these ruptures into the space between the core and face sheet, effectively terminating the forming process. The superplastic characteristics of the material in the heat affected zone around the weld is degraded compared to the material outside the heat affected zone, so it is difficult to optimize all the various process and material parameters for a given cell span and height by analysis during development. Such ruptures in the core prevent the part from forming properly, so it is immediately identified as a failed part and is scrapped. It is a source of increased development cost, increased weight when heavier gauge material must be used to prevent tears from occurring in the core pack sheets, and reduced production speed when longer forming times are required to prevent tearing. The problem has exasperated engineers and other workers in the art because the cause of the problem was not understood and because no reliable, consistent solution existed to correct the problem.

SUMMARY OF THE INVENTION

Accordingly, this invention provides an improved process for forming multisheet monolithic metal sandwich structures, and provides an improved process for making a multisheet monolithic metal sandwich structure, and the structure made thereby, having face sheets and diffusion bonded, apertured internal webs extending between the face sheets defining closed cells therebetween. The webs have reduced thinning around the apertures through the webs and hence reduced tendency to rupture during formation compared to similar structures made by prior art processes. The invention provides an improved method of making a multisheet monolithic metal sandwich structure having a forming speed significantly faster than was previously possible, and it provides an improved method of making a multisheet metallic sandwich structure having cells with a greater depth-to-span ratio than was previously possible.

One embodiment of the invention begins by selecting at least two chemically clean metal sheets, which exhibit superplastic characteristics at a particular temperature range, for forming a core of the sandwich structure. The core sheets are placed in a vertical stack, and welded together in a weld pattern having intersecting weld lines defining cells therebetween. The weld pattern has gaps adjacent the intersections of the weld lines to allow passage of forming gas into each cell during superplastic forming. One or more gas pressure line fittings are inserted between the core sheets along at least one edge, and the core sheets are welded or otherwise sealed around the peripheral edge to form a sealed core pack having gas fittings for admission of a pressurized forming gas to form the pack.

A chemically clean superplastic metal face sheet is placed on the top face and another on the bottom face of the core pack. An envelope gas fitting is positioned in a notch in the core pack between the face sheets, and the peripheral edges of the face sheets and the core pack are seal welded with the gas fittings protruding to produce a sealed envelope pack enveloping the core pack. The envelope gas fitting provides a passage for forming gas into a face sheet zone between the face sheets and the core pack.

A gas supply tube is connected from a gas supply control system to each of the fittings, and air and moisture are purged from the packs. The packs are pressurized with a dry, inert forming gas such as Argon from the gas supply system. The core pack is pressurized to a higher pressure than the face sheet zone and placed in a preheated die having an internal cavity with a complementary shape as the desired shape of the metal sandwich structure after it is expanded. The die temperature is at about the designated forming temperature of the metal, which is in the superplastic range for that metal. For titanium 6-4 alloy, the forming temperature is about 1650° F. In the die cavity, the temperature of the full pack rises to the designated forming temperature of the metal, and forming gas is injected through the fittings to inflate the envelope pack to the interior walls of the cavity, following a pressure schedule based on the optimal strain rate for the material. The core pack is then similarly inflated against the inside of the envelope pack, folding over on itself about the weld lines to form the webs of the core and diffusion bonding to the inside of the envelope pack to form an integral structure. The placement of the gaps in the weld lines adjacent to the weld line intersections reduces the stresses and material strain encountered around the weld gap during forming, which reduces the tendency of the core to rupture during forming. After forming is completed, the forming gas pressure is reduced to near ambient, and the forming gas pressure in the core pack is reduced to near ambient, just enough to ensure that a partial vacuum is not created in the part as it cools, which would tend to produce hollows in the part between the webs. The die is opened and the formed pack is removed from the die and is allowed to cool below 900° F. while remaining connected to the gas supply system, then the gas supply lines are removed from the gas fittings. Portions of the peripheral flange holding the gas fittings may be trimmed off of the formed pack.

The metallic sandwich structure produced by this process can be made with thinner gauge material so it can be made lighter and less costly than parts made by the prior art processes. The cells in the part can be made with cells having a greater depth/span ratio which potentially provides greater load-carrying capacity for the same weight part. The forming time for parts made with this process can be significantly shorter than that needed for prior art processes, thereby increasing the throughput in a production operation and thus reducing the cost per part.

DESCRIPTION OF THE DRAWINGS

The invention and its many attendant benefits and advantages will become more clear upon reading the following description of a preferred embodiment in conjunction with the following drawings, wherein.

DESCRIPTION OF THE PREFERRED EMBODIMENT

Figure 1:
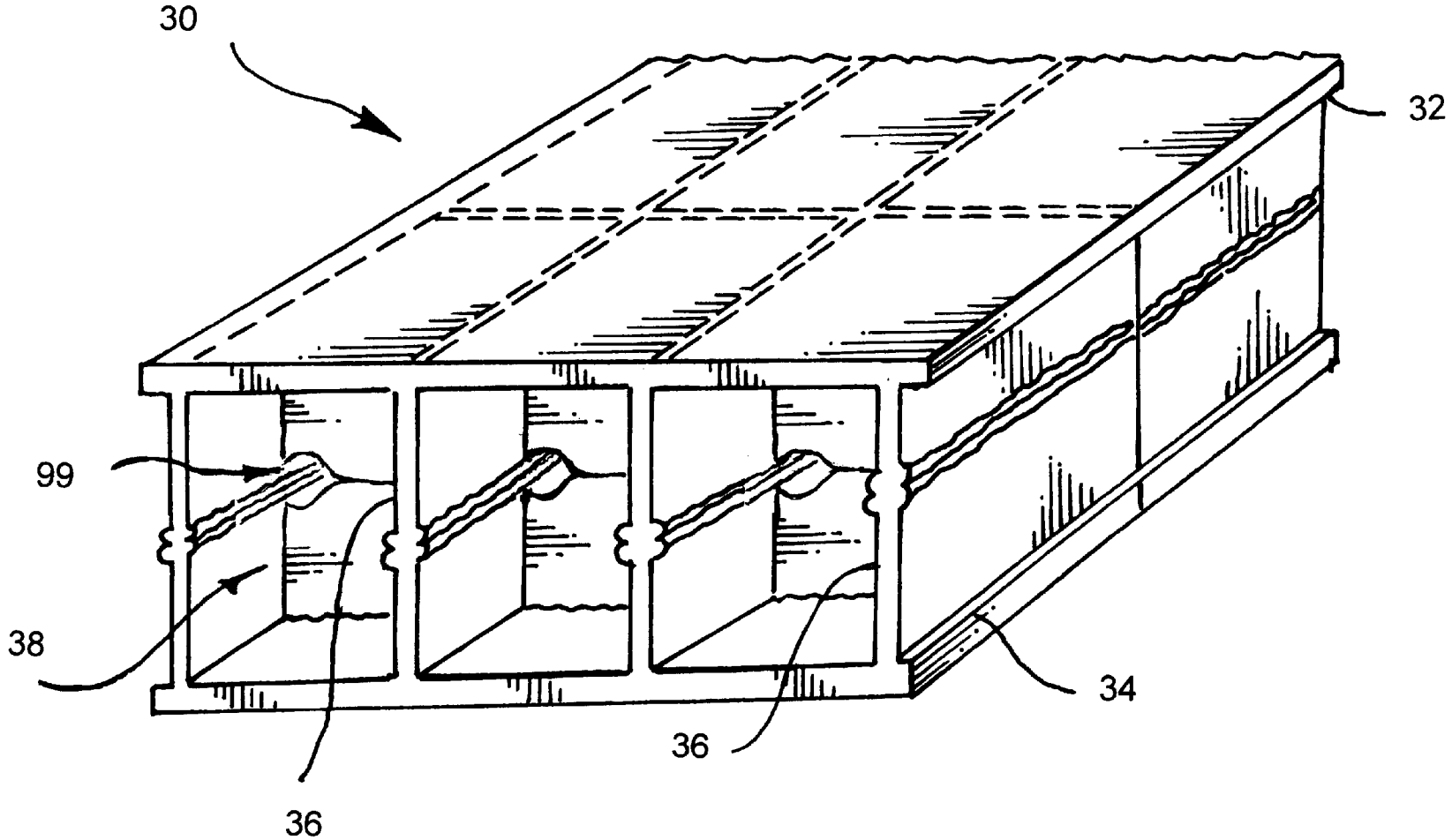
FIG. 1 is a perspective view of a four-sheet monolithic metal sandwich structure made in accordance with this invention, showing the corner gaps in the webs.

Turning now to the drawings, wherein like reference numerals designate identical or corresponding parts, and more particularly to FIG. 1 thereof, a four-sheet monolithic metal sandwich structure 30 made in accordance with this invention is shown having a top skin 32, a bottom skin 34, and a plurality of webs 36 extending between and integrally connected to the top and bottom skins, producing a monolithic structure. The webs 36 are preferably arranged as indicated to form a plurality of square or rectangular cells 38, although cells of other shapes can be formed, such as hexagonal cells made with webs in a hexagonal pattern.

The sandwich structure shown in FIG. 1 is made from four sheets of a metal, such as titanium 6Al-4Vanadium alloy, which has super-plastic and diffusion bonding characteristics. Superplastic characteristics include the capability of the metal to develop unusually high tensile elongations and plastic deformation at elevated temperatures, where the material has a reduced tendency toward necking or non-uniform thinning. Diffusion bonding refers to metallurgical joining of two pieces of metal by molecular or atomic co-mingling at the faying surface of the two pieces when they are heated and pressed into intimate contact for a sufficient length of time. It is a solid state process resulting in the formation of a single piece of metal from two or more separate pieces, and is characterized by the absence of any significant change of metallurgical properties of the metal, such as occurs with other types of joining such as brazing or welding, and little or no metallurgical differentiation across the junction zone. The characteristics of superplastic forming and diffusion bonding are now reasonably well understood, and are discussed in detail in U.S. Pat. Nos. 3,927,817 to Hamilton and 4,361,262 to Israeli.

Figure 2:
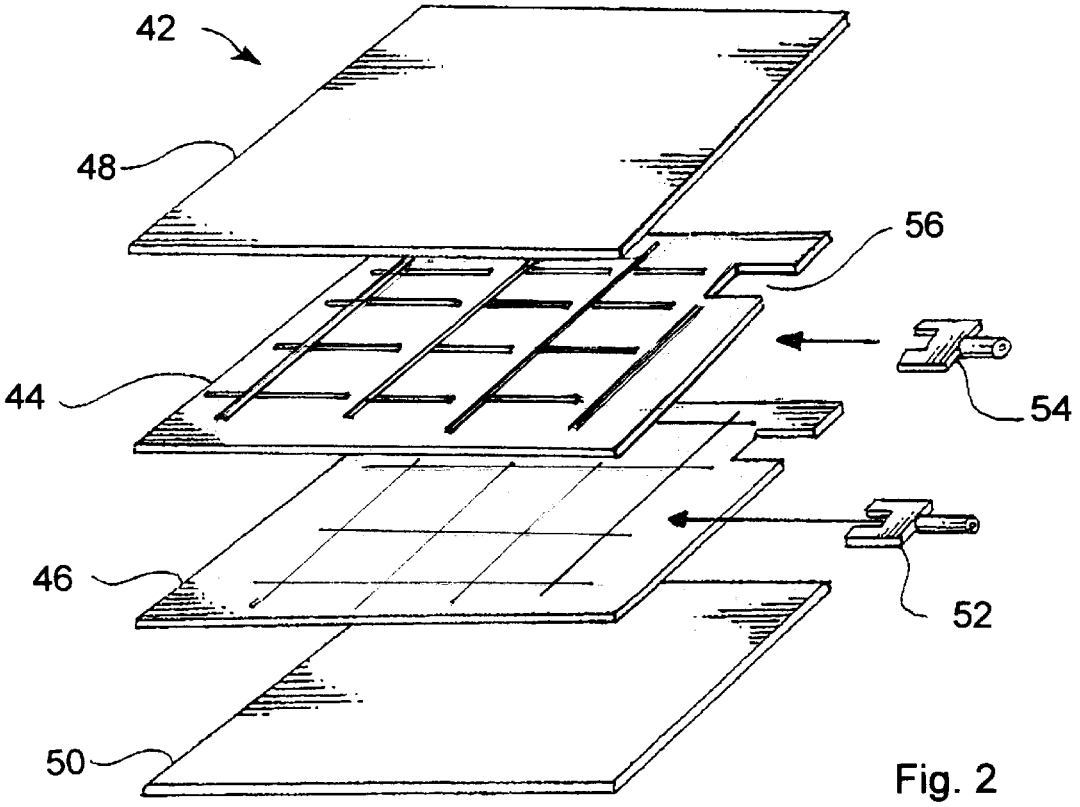
FIG. 2 is a schematic exploded diagram showing the four sheets which make up the sandwich structure shown in FIG. 1, and showing the weld pattern that will be used to weld the core pack.

Four sheets of superplastic metal are selected for a stack 42, shown in exploded form in FIG. 2, which will make up the sandwich structure shown in FIG. 1. This description will discuss a titanium alloy part made with a suitable superplastic alloy of titanium, such as Ti-6-4. The stack 42 includes two core sheets 44 and 46 and top and bottom face sheets 48 and 50. The sheets are all cut to the desired size, which is the size and shape of the plan form of the sandwich structure part, plus about 2"–6" for a flange 58 around the part by which the part may be clamped in a superplastic die 112, shown in FIGS. 6B–E, and by which it may be attached into an assembly for which it is intended. A trim margin also is generally designed into the part for the gas fittings or to accommodate part curvature and geometry.

After cutting, the sheets are cleaned to remove ink markings printed on the sheets by the manufacturer. Acetone readily removes the ink markings. The sheets are then chemically cleaned, first to remove grease and other such contaminants, and then to remove metal oxides from the titanium alloy sheets. Immersion first in an alkaline bath and then in an acid bath, such as 42% nitric acid and 2.4% hydrofluoric acid is one effective chemical cleaning process. The cleaned sheets are rinsed in clean water to remove residues of the acid cleaner, but residues from the rinsing solution remain on the sheets after removal from the rinsing bath. These residues are removed from the sheets by wiping with a fabric wad, such as gauze cloth, wetted with a reagent grade solvent such as punctilious ethyl alcohol. The sheets are wiped until the gauze comes away clean. The alcohol evaporates leaving no residue and leaving the sheets free of contaminants that would interfere with a complete and rapid diffusion bond when the conditions for such a bond are established.

An alternate to the acid bath cleaning is another chemical cleaning technique disclosed in U.S. Pat. No. 5,681,486 issued to Herbert Goode et al. for "Plasma Descaling of Titanium and Titanium Alloys" or in U.S. Pat. No. 60,010,635. Either technique provides virtually complete cleaning of oxides and other contamination from the inside and outside surfaces of the titanium core sheets 44 and 46. These chemically clean surfaces will diffusion bond properly around the peripheral edge of the core pack, and the outside surfaces of the core pack will diffusion bond to themselves when they are folded around the weld lines to form the webs. The inside surfaces of the face sheets 48 and 50 are similarly chemically cleaned so they will diffusion bond to the outside surfaces of the core sheets 44 and 46 to form an integral unitary structure, as described below.

A stop-off compound such as boron nitride is applied over the entire surface of at least one of the core sheets 44 and 46 except for the peripheral edge portion which is masked to remain free of stop-off. For large area surfaces, boron nitride stop-off may be dissolved in a solvent such as a mixture of water and alcohol and sprayed with an electrostatic sprayer onto the entire surface area of the one side of the one sheet. The water and alcohol evaporate, leaving a thin, even coating of boron nitride on the surface. For smaller surfaces, the stop-off may be sprayed from an aerosol can of a solution of boron nitride in an alcohol solution that is commercially available from the Cerac Company in Milwaukee, Wis. Other suitable techniques may be use to apply the stop-off.

Figure 4:
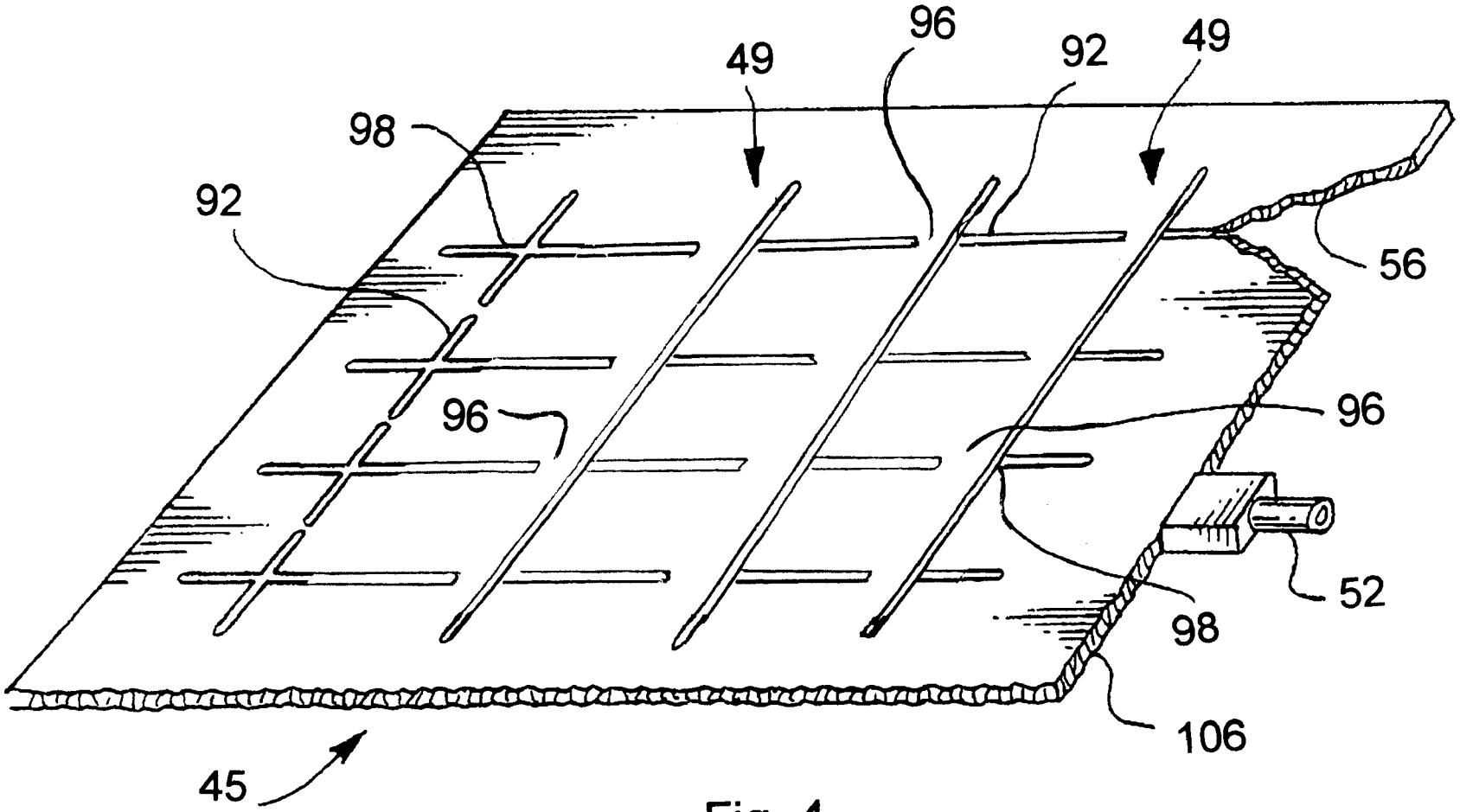
FIG. 4 is a perspective view of a seal-welded core pack for use in making the sandwich structure shown in FIG. 1.
Figure 5:
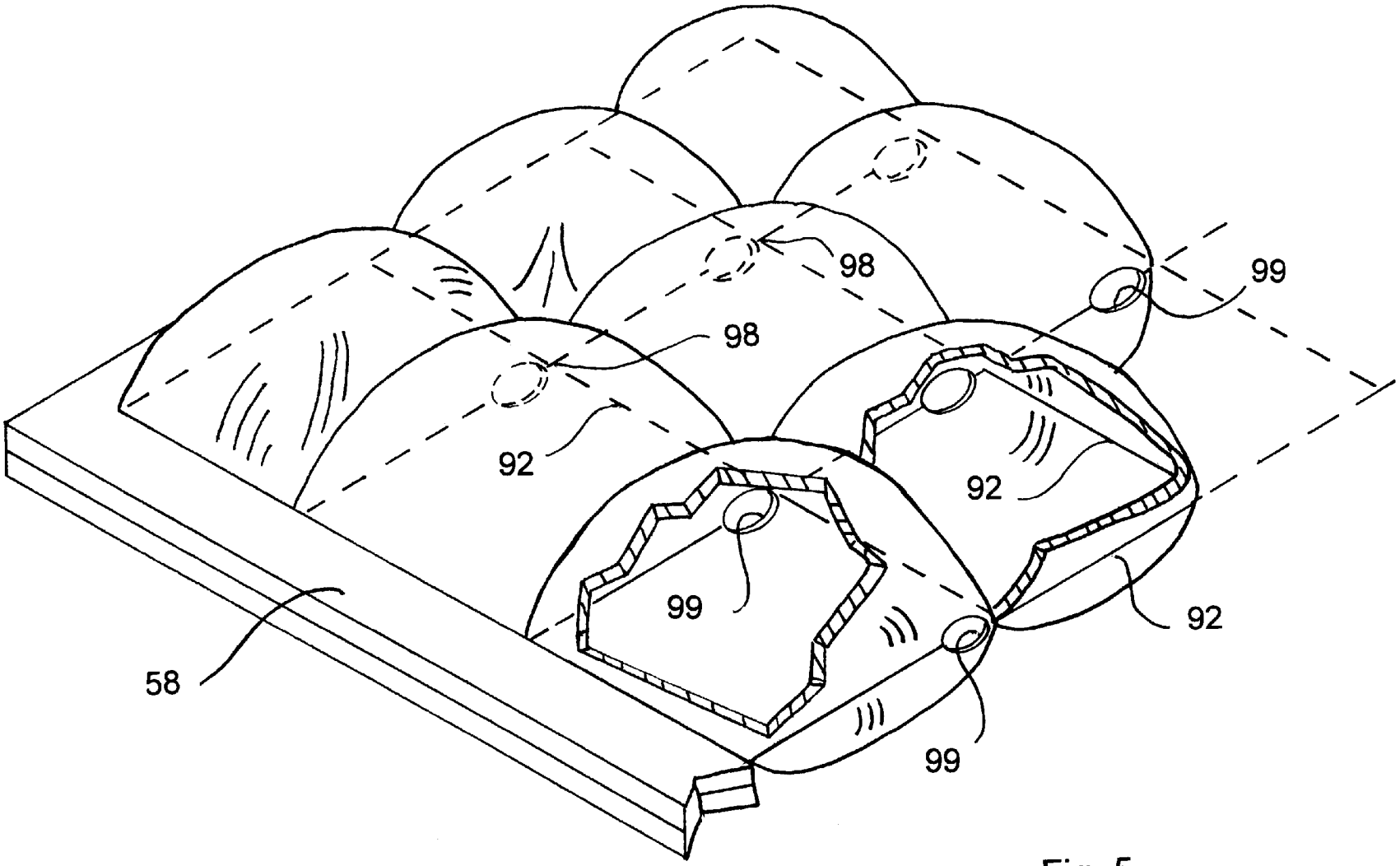
FIG. 5 is a perspective, partially broken-away, view of a portion of the core pack shown in FIG. 4, partially inflated.

The coated core sheet is aligned with and abutted face-to-face against the other core sheet, with the stop-off coated face facing the other sheet. The two core sheets 44 and 46 are welded in the "T" welding pattern shown in FIGS. 2 and 4. The welding can be by laser welding on a laser welding apparatus purchased from Convergent Energy Corp. in Sturbridge, Mass., using a pressure trolley device described in the aforesaid "Multisheet Metal Sandwich Structure" patent application of Fred Buldhaupt et al. Welding can also be done using a electrical resistance welding, as described in U.S Pat. No. 4,304,821 to Hayase, et al., using an electrical seam welder with a roller that presses the sheets together while conducting electrical current of sufficient wattage to fuse the two sheets together in an weld line. The weld line pattern of this invention has gaps 96 adjacent the weld line intersections 98, as shown in FIGS. 2 and 4, instead of the intermittent weld lines taught by Hayase et. al. This weld line pattern produces gas passage openings 99 in the corners of the cells, as shown in FIGS. 1 and 5. The corner locations of these openings 99 are important to the success of the method of this invention as explained in greater detail below.

Figure 3A:
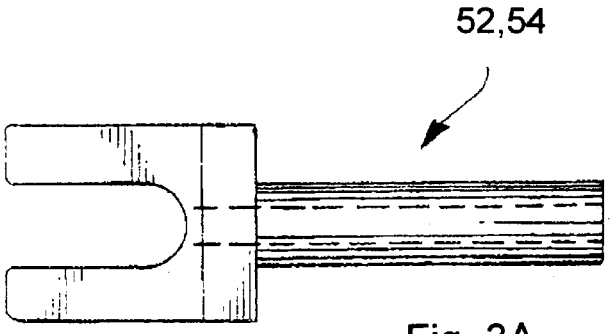
FIGS. 3A–C are orthogonal views of a gas fitting used in this invention.
Figure 3C:
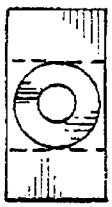
Figure 3B:
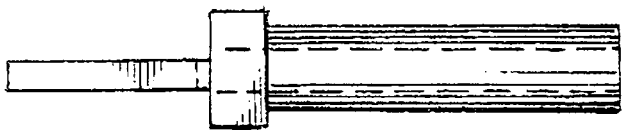

A core gas fitting 52, shown in FIGS. 3A–C, is inserted between the two core sheets 44 and 46 to be welded together to make up a core pack 45, shown in FIG. 4. The core gas fitting 52 provides a connection to a gas supply system for supplying forming gas into the interior of the core pack 45 for purging the core pack of air, and for inflating the core pack 45 during superplastic forming as illustrated in FIGS. 5 and 6A–E, and as described in more detail below.

As shown in FIG. 2, an envelope gas fitting 54 is inserted between the two face sheets 48 and 50 and aligned with a notch 56 in the core pack 45, and is welded into place by peripheral welding around the two face sheets to make an envelope pack which encloses the core pack 45. The gas fitting 54 communicates with the interior of an envelope to provide a gas flow path into the space above and below the core pack 45 between the face sheets 48 and 50 for superplastic forming the face sheets against the interior surfaces 114 of a forming die 112, as illustrated in FIGS. 6A–E and described below.

After the "T" grid pattern shown in FIG. 4 is laser welded or electrical resistance welded into the sheets 44 and 46, the sheets 44 and 46 are seal welded completely around their periphery and around the core gas fitting 52 to fully seal the periphery of the core pack 45. A convenient type of welding for this purpose is gas tungsten arc welding (also referred to as TIG welding) wherein the welding arc can be directed into the edge face of the sheets 44 and 46. A conventional stainless steel compression coupling such as a Swagelock coupling (not shown) is attached to the gas fitting 52, and one end of a short length of stainless steel gas tubing is attached to the compression coupling. The other end of the tube is pinched shut and welded closed to seal off the interior of the core pack 45 against intrusion of cleaning solution for the following cleaning operation.

The sealed core pack 45 is cleaned by immersion in the alkaline bath and the pickling bath as describe above and is wiped with a fabric wad wetted with punctilious alcohol, as also described above. The cleaned core pack 45 is assembled between the cleaned face sheets 48 and 50, with the envelope gas fitting 54 positioned in the notch 56, and the periphery of the two face sheets 48 and 50 plus the core pack 45 is seal welded all around and around the envelope gas fitting 54 to produce a full pack 110 which is completely sealed, except for the gas flow path provided into the envelope pack 49 between the face sheets 48 and 50 through the envelope gas fitting 54 and the notch 56.

The envelope gas fitting 54 is sealed with another pinched and welded tube in a compression coupling, as described above for the core pack 45, and the full pack is cleaned as before. After cleaning, the full pack is now ready for superplastic forming and diffusion bonding to produce the monolithic metal sandwich structure of this invention. The process is schematically illustrated in FIGS. 5 and 6A–E and described below.

The external surfaces of the pack 110 are coated with a parting agent, such as the boron nitride stop-off described above. Compression fittings are attached to the gas fittings 52 and 54 and gas lines from a forming gas control system, such as that described in U.S. Pat. No. 5,419,170 to Sanders et al. are connected to the compression couplings. The full pack is purged with dry inert gas, such as argon, to remove air and moisture from inside the envelope pack 49 and the core pack. The purging may be accomplished with several cycles of alternate vacuum suction and backfilling with argon under a pressure of about 0.5 PSI in the envelope pack 49 and about 10 PSI in the core pack 45, until the interior of the packs 45 and 49 are purged clean of air and moisture. The packs 45 and 49 are now pressurized with argon to separate the surfaces from each other. The pressure inside the core pack 45 is preferably higher than the pressure in the envelope pack 49 because the grid welds 92 tend to hold the core sheets 44 and 46 together more tightly than the peripheral weld holds the face sheets 48 and 50 together. The initial pressure is about 0.1 PSI in the skin zone within the envelope pack and about 10 PSI in the core pack 45. The core pressure is sufficient to prevent contact and premature diffusion bonding between the facing surfaces of the sheets, but not so high as to cause premature pillowing of the core envelope or tearing of the sheets at the laser welds or the peripheral welds. The pressurized pack 110 is placed in a die 112 preheated to the forming temperature or slightly above forming temperature, which is about 1650° F. for titanium 6-4 alloy, and the die is closed with a superplastic forming press (not shown). The die may be provided with grooves extending from an internal cavity to the exterior in which the gas fittings 52 and 54 lie to avoid squeezing shut the gas passages through the flange 58. After closing the die, the pressure of the forming gas in the envelope pack 49 is immediately increased to ensure expansion of the face sheets 48 and 50 away from the core pack 45, and the pressure in the core pack 45 is also increased to resist the compression of the gas pressure in the envelope pack 49.

Figure 6A:
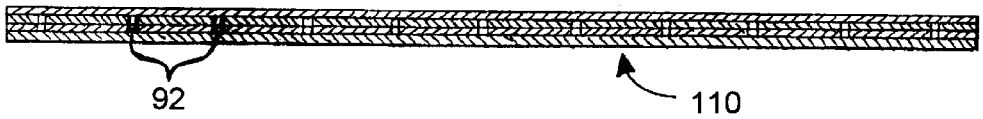
FIGS. 6A–6E are schematic diagrams showing the superplastic forming of the welded pack to produce the sandwich structure shown in FIG. 1.
Figure 6B:
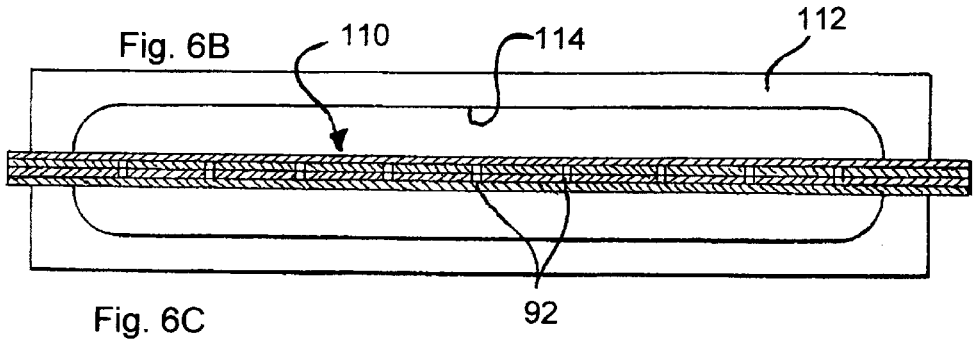
Figure 6C:
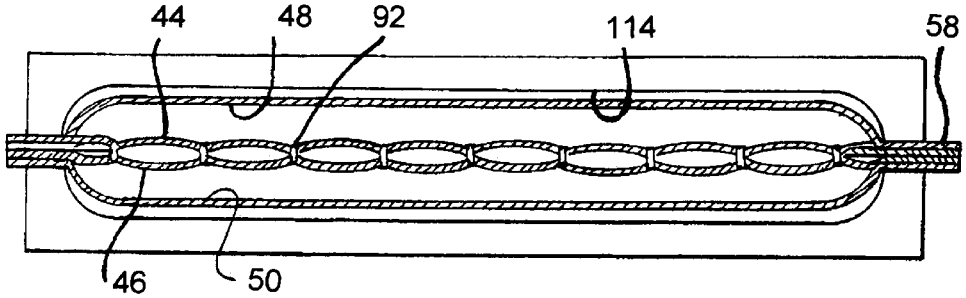
Figure 6D:
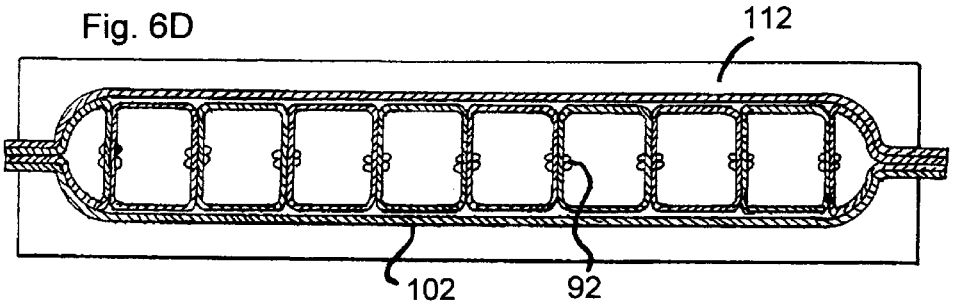
Figure 6E:
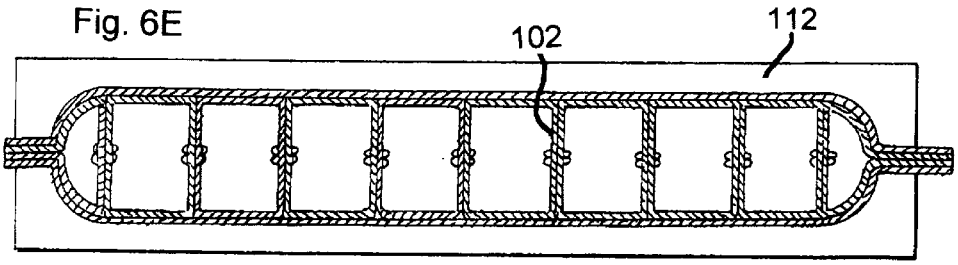

After the pack reaches forming temperature inside the die 112, the pressure in the envelope pack 49 and the core pack 45 is increased to forming pressure, and the sheets 44, 46, 48 and 50 stretch superplastically as shown in FIGS. 5 and 6C–D, and diffusion bond into an integral monolithic structure as shown in FIGS. 1 and 6E.

After the pack 110 is fully formed, as shown in FIG. 6E, the pressure is reduced to near ambient, about 0.05 PSI and the press is opened to open the die 112. The sandwich part is removed from the die cavity 114 and is allowed to cool while the gas pressure is maintained slightly above ambient to prevent the cooling part from pulling a vacuum and collapsing under air pressure. After cooling below 900° F., and preferably under 500° F., the gas lines are removed from the compression couplings, and the part is sealed with pinched and welded gas lines in the couplings for recleaning any external alpha case that may have formed on the part from high temperature contact of the external surfaces with air. After cleaning, the part may be trimmed to remove the gas fittings 52 and 54, and the part is completed.

The gaps 96 in the weld lines 92 provide the passage 99 in the webs surrounding the cells through which forming gas can flow when the core pack 45 is superplastically formed. Forming is accomplished by heating the part in a die to forming temperature, which for 6-4 titanium alloy is preferably about 1650° F., and injecting forming gas through the core gas fitting 52, as illustrated schematically in FIG. 5. When the core pack 45 is inflated, the gaps 96 open to produce the round or tear-drop shaped openings 99 in the webs 36 formed by the material of the top and bottom core sheets 44 and 46 as the material stretches superplastically away from the laser welds 92 and folds back over onto itself to form the webs, as illustrated in FIGS. 5 and 6C–E.

The pattern shown in FIGS. 2 and 4, denoted the "T-weld pattern" herein, provides significant benefits over the conventional center weld pattern, known as the "X" weld pattern in the prior art, as described in the aforesaid "Multisheet Metal Sandwich Structure" patent application of Fred Buldhaupt et al. and also over the intermittent welding pattern described in the aforesaid Hayase et al. patents. Analysis and experimental observation agree that areas of high local plastic strain (significant local sheet thin-out) are very close to the rupture locations in trial parts made using the "X" weld pattern in which the weld gap is at or near the midpoint of the weld line between the two adjacent intersecting weld lines. This rupture location is adjacent to the weld gap, usually in the heat-affected zone in a region lying at about 45° above and below the weld seam at mid-span in the cell. This high localized plastic strain is a result of the combined effect of 1) degraded properties for the material in the heat affected zone and 2) hardening of the material in the high strain regions due to the strain-rate sensitivity of the material, and 3) the center or mid-span location of the weld gap as the sheet stretches and folds back upon itself and the pressure feed-thru hole 99 opens up while the core expands into the die cavity. The combination of these effects causes strain rates exceeding the optimal rates and consequent necking in those regions. The result is significantly higher flow stress and excessive thinning in those regions of the weld zone. Moreover, the regions where the material has thinned the most also happen to coincide with regions of maximum stress that the formed part experiences in use.

In the use of this invention, on the other hand, weld gaps 96 adjacent the intersections 98 of weld lines 92, as provided in this invention, lie in a region of lower forming stresses, so the opening of the weld gap, which produces the pressure feed-through hole 99 in the web 36, proceeds at a slower rate. It does not have the same tendency to neck down and exhibits less local thin-out. Moreover, the highest stress rise during loading of the formed part in use occurs near the deepest region of hole opening, which is a region where the material has thinned very little. An additional feature provided by positioning the weld gap adjacent the web intersections is that, for the first time, parts can be made with cells having a very deep depth-to-span aspect ratio, on the order of 1:1. That is, cells 2"–3" wide can be made 2"–3" deep. Sandwich structures with cells this deep have never before been possible in a production environment.

Figure 7:
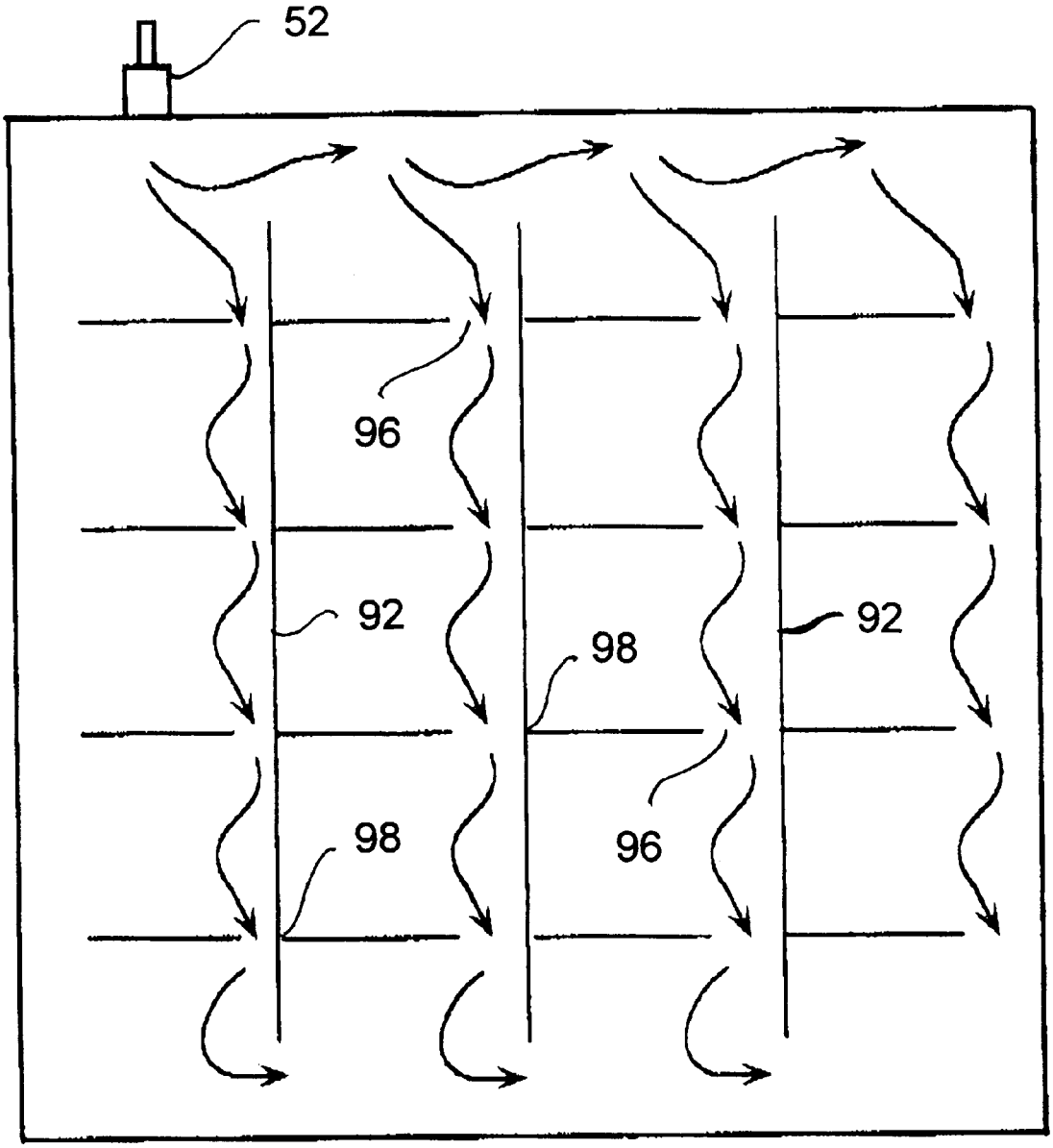
FIG. 7 is a plan view of a core pack using the "T-weld" weld pattern in accordance with this invention.
Figure 8:
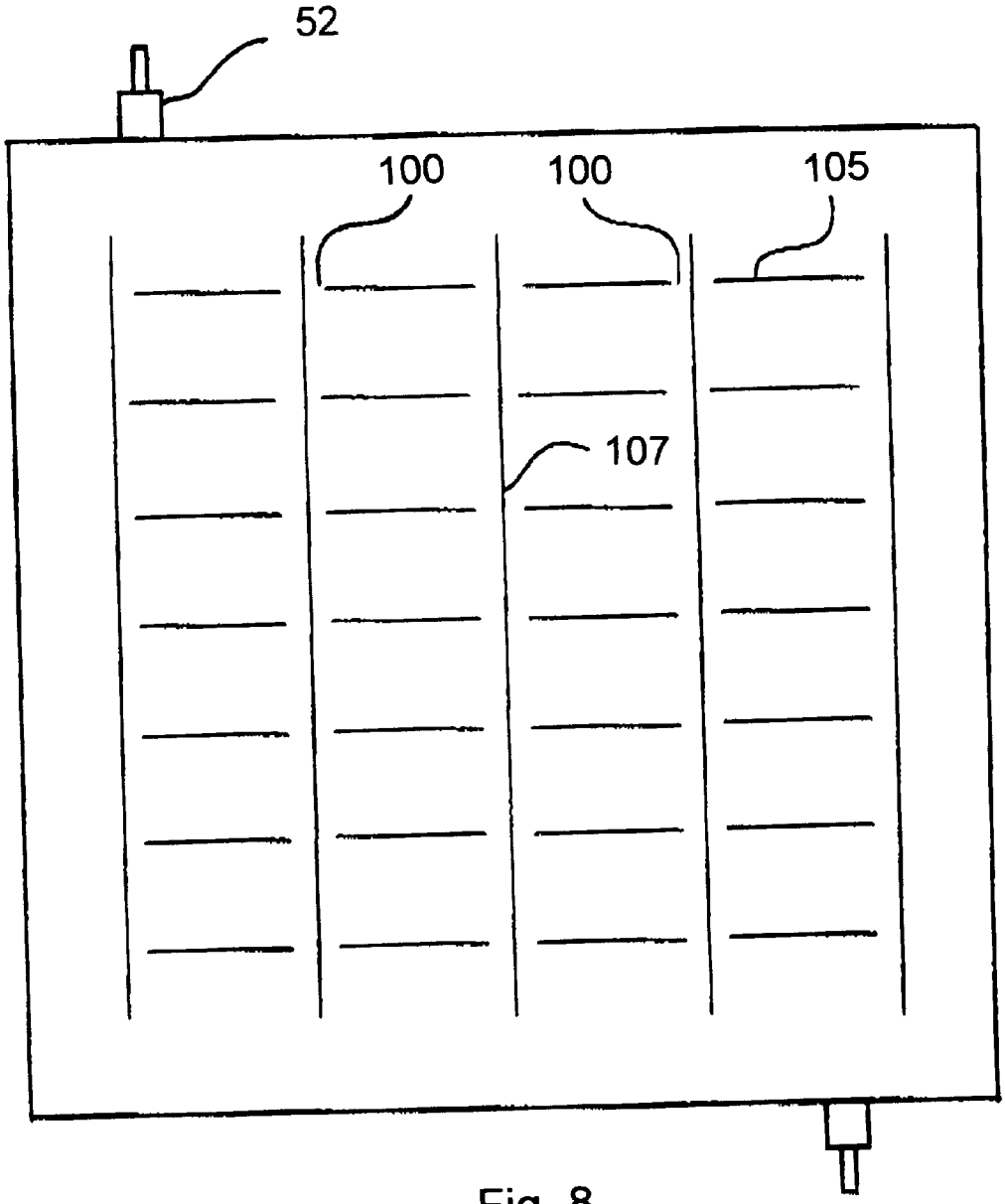
FIG. 8 is a plan view of a core pack welded with a "half open" weld pattern in accordance with this invention.

The T-weld patterns shown in FIGS. 2, 4 and 7 provide all the benefits noted above for the invention. However, there are several alternative welding patterns in accordance with this invention that also position the weld gap adjacent the weld line intersections to achieve all or most of the benefits of the invention. One such alternative welding pattern, shown in FIG. 8, denominated the "half-open" pattern herein, has a gap 100 in the broken weld line 105 on each side of the inside unbroken intersecting weld lines 107. This welding pattern simplifies the indexing of the start/stop welding of the broken weld line 105 to produce a weld gap 100 on both sides of the inside unbroken weld lines 107. Each cell thus has four openings for providing communication of forming gas through the cells to minimize the chances of blockage in the flow of forming gas within the core pack, and also to provide maximal flow channels when the core pack is used as a flow channel for cooling gas flow through the part.

Figure 9:
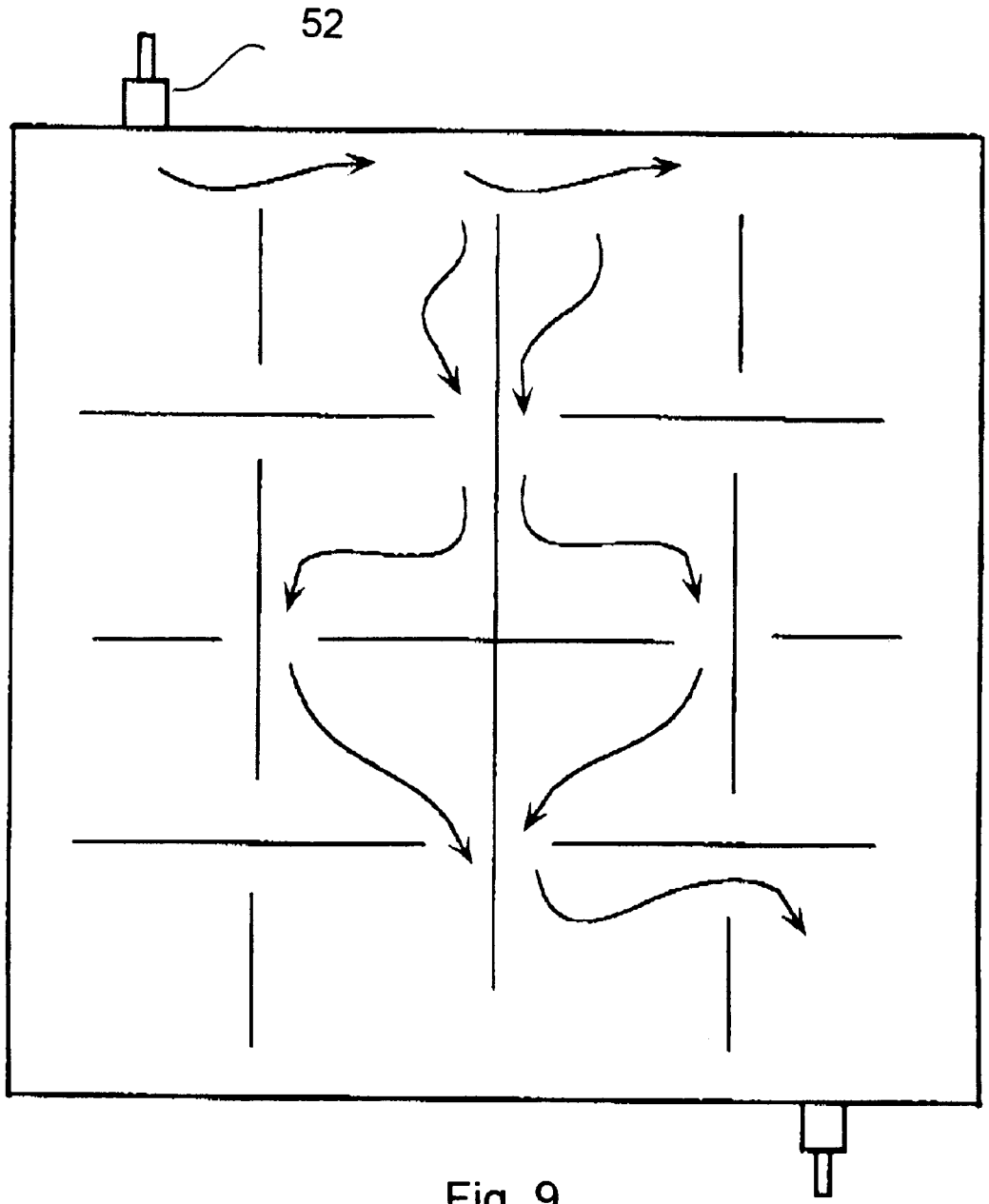
FIG. 9 is a plan view of a core pack welded with a "staggered half open" weld pattern in accordance with this invention.

Another alternative welding pattern in accordance with this invention is shown in FIG. 9 and denominated the "staggered half-open" pattern. This pattern also has four openings in each cell, but the flow channels through each cell are off-set from the adjacent cell. This pattern also simplifies the indexing of start/stop welding of the weld lines so precision starts or stops do not need to occur precisely at the unbroken weld line, as shown in FIG. 9.

Figure 10:
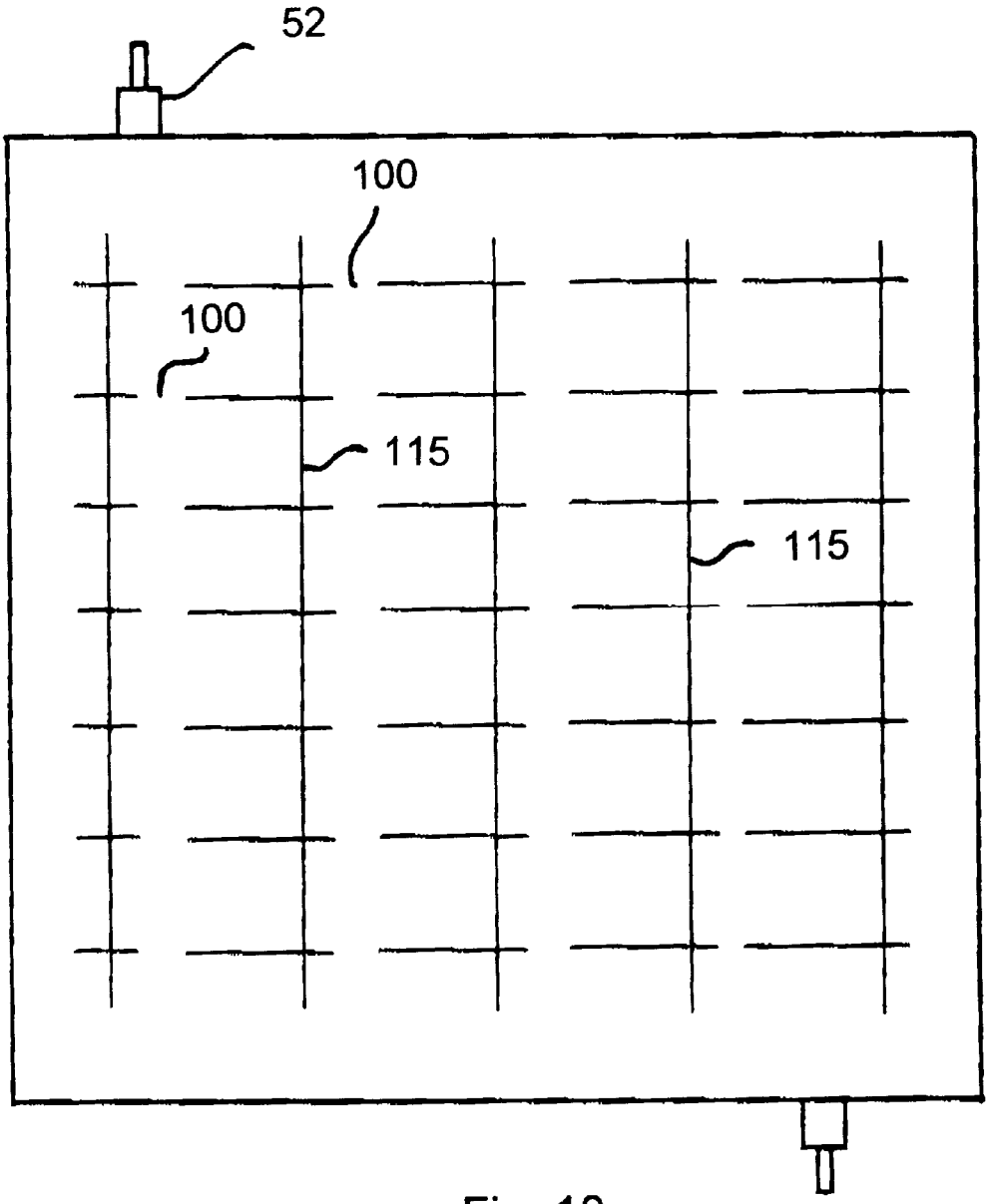
FIG. 10 is a plan view of a core pack welded with a "75%" weld pattern in accordance with this invention.

Still another alternative welding pattern in accordance with this invention is shown in FIG. 10 and denominated the "75%" pattern. This pattern, which positions the weld gap 100 about 75% of the way toward the transverse weld line 115, with both ends within a space that is no more than about 75% of the distance of the weld line between intersecting weld lines, also offers significant improvement over the standard "X" pattern and provides an easy solution to any weld seam start/stop indexing problems that might be encountered with the "T" weld pattern.

The particular weld pattern used is chosen based on part configuration, desired gas flow rate through the part core, anticipated part loading in use and other such practical considerations. The benefits of the invention in terms of its core rupture reduction are substantially available for all these embodiments and their equivalents.

Obviously, numerous modifications and variations of the preferred embodiments described above are possible and will become apparent to those skilled in the art in light of this specification. For example, many functions and advantages are described for the preferred embodiments, but in many uses of the invention, not all of these functions and advantages would be needed. Therefore, we contemplate the use of the invention using fewer than the complete set of noted features, benefits, functions and advantages. Moreover, several species and embodiments of the invention are disclosed herein, but not all are specifically claimed, although all are covered by generic claims. Nevertheless, it is our intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, are to be considered within the spirit and scope of the invention as defined in the following claims, wherein

We claim:

1. A method of making an monolithic metal sandwich structure, comprising:

selecting at least two metal sheets having superplastic characteristics for forming a core of said sandwich structure, said core sheets having a surface area and planar shape at least equal to the plan size and shape of said core of said metal sandwich structure;

placing said core sheets in a vertical stack;

inserting a gas pressure line fitting between said core sheets on at least one edge thereof, said fitting having a through bore communicating through said fitting into an interior region between said core sheets;

welding said gas pressure line fitting to said core sheets;

pressing said core sheets together and welding said core sheets forming a core pack, said welding being done along intersecting weld lines which will form junction lines between said core sheets and delineate cells within said core pack when said core pack is superplastically expanded;

leaving gaps in said weld lines through which gas can pass from said gas pressure line fitting into and through said cells, said gaps being located adjacent intersections of said weld lines;

selecting at least two additional metal sheets having superplastic characteristics for forming face sheets of said sandwich structure;

placing one each of said sheets on top and bottom faces of said core pack and placing an envelope gas fitting between said face sheets;

sealing peripheral edges of said face sheets to peripheral edges of said core pack and sealing said gas fittings between said face sheets to produce a sealed envelope pack enclosing said core pack, with gas fittings into said core pack and into a face sheet zone between said face sheets and said core pack;

connecting a gas supply tube from a gas supply control system to each of said fittings and purging air and moisture from said packs;

pressurizing said packs to a low pressure with an inert forming gas such as argon, said core pack being pressurized to a higher pressure than said envelope pack;

placing said full pack in an internal cavity of a heated die, said cavity having the same shape as the desired shape of the metal sandwich structure after it is expanded;

raising the temperature of said full pack in said die to a temperature at which said metal exhibits superplastic characteristics;

injecting forming gas through said fittings at a forming pressure sufficient to inflate said envelope pack to the interior walls of said cavity, and inflate said core pack to said envelope pack;

forming said envelope pack against the interior walls of said cavity, and forming said core pack against inside surfaces of said envelope pack while folding said sheets of said core pack over on themselves about said weld lines to form said webs and expand said weld gaps into openings in said webs;

maintaining said forming gas pressure until said core sheets are diffusion bonded to said face sheets and are diffusion bonded to themselves to form said webs;

opening said die and removing said formed pack from said die;

allowing said formed pack to cool and removing said gas supply lines from said gas fittings.

2. A method as defined in claim 1, wherein:

said forming of said core pack occurs while maintaining said webs free of ruptures.

3. A method as defined in claim 1, wherein:

said openings are big enough to allow a flow of cooling air through said core.

4. A method as defined in claim 3, wherein:

said openings are aligned in straight rows through said core to facilitate said cooling air flow through said core.

5. A method as defined in claim 1, wherein:

maximum forming stress in marginal regions around said openings is reduced compared to corresponding stress in similar parts with equal cell size having openings located centrally in the web.

6. A method as defined in claim 1, wherein:

a plurality of said gaps in said weld lines have one end adjacent an intersecting weld line.

7. A method as defined in claim 1, further comprising:

a plurality of said gaps in said weld lines lie in pairs on opposite sides of an intersecting weld line.

8. A method as defined in claim 7, wherein:

said pairs of gaps occur at every other intersecting weld line in both orthogonal directions in said pattern.

9. A method as defined in claim 1, wherein:

a certain distance exists along some weld lines between said intersecting weld lines; and a plurality of said gaps in said some weld lines have both ends within a space that is no more than about 75% of said distance of said weld line between said intersecting weld lines.

10. A method of making an monolithic metal sandwich structure, comprising:

selecting two or more sheets of superplastic metal to be welded together as a core pack;

stacking said sheets in a vertical stack and pressing said sheets into intimate contact at a point at which welding is to be initiated;

initiating a weld at said point and continuing said weld in a grid pattern of intersecting weld lines, defining boundaries of cells in said core pack;

interrupting said weld lines to leave gaps in said weld pattern adjacent a plurality of said weld line intersections;

connecting said core pack to a source of gas pressure;

heating said core pact to a temperature at which said material exhibits superplastic properties; and superplastically forming said sheets against interior die surfaces by inflating said core pack with gas pressure against said interior surfaces and folding each of said sheets about said weld lines into contact with itself to produce intersecting webs defining said cells, said cells being in gas communication with said source of gas pressure through openings in said webs produced by said sheets pulling away from said grid pattern at said weld line gaps during said superplastic forming step;

whereby said marginal regions around said opening are subjected to lower levels of stress and thin-out during forming of said core pack compared to stress levels and thin-out that would occur in marginal regions around openings located centrally between said intersections.

11. A method as defined in claim 10, wherein:

a plurality of said gaps in said weld lines have one end at an intersecting weld line.

12. A method as defined in claim 10, wherein:

a plurality of said gaps in each of said weld lines lie on opposite sides of an intersecting weld line.

13. A method as defined in claim 12, wherein:

a plurality of said gaps in each of said weld lines lie on opposite sides of an intersecting weld line.

14. A method of as defined in claim 10, wherein:

a plurality of said gaps in said weld lines have both ends within a space that is no more than about 75% of the distance of said weld line between intersecting weld lines.

15. A multisheet, superplastically formed monolithic metal sandwich structure, comprising:

a top sheet and a bottom sheet, and a multiplicity of intersecting webs coupled between said top and bottom sheets by diffusion bonding;

said webs and said top and bottom sheets defining therebetween and enclosing therewithin a multiplicity of cells;

at least one web around each cell having an aperture therein allowing passage of pressurizing gas used during superplastic forming of said sandwich structure to inflate said cells and to apply internal pressure in said cells to superplastically form said sheets and to achieve said diffusion bonding, said apertures being located adjacent an intersection of said webs in a location in which forming stresses during superplastic forming of said sandwich structure are minimal.

16. A sandwich structure as defined in claim 15, wherein:

one edge of said apertures in said apertured web coincides with a web with which said apertured web intersects.

17. A monolithic core in a superplastically formed metallic sandwich structure, comprising:

at least two metal sheets having superplastic characteristics when heated to high temperature;

said sheets being welded together along a multiplicity of intersecting weld lines;

at least some of said weld lines having gaps adjacent to intersections with other weld lines in a location that experiences low strain during superplastic expansion;

whereby said core can be superplastically expanded by injecting forming gas between said metal sheets and said forming gas flows through said gaps and between all of said weld lines to superplastically expand said core and expand said gaps into openings while avoiding ruptures in said sheets.

18. A monolithic core as defined in claim 17, wherein:

said gaps in some weld lines have one edge coinciding with intersections with other weld lines.

19. A method for making an monolithic metallic core in a superplastically formed multisheet metal part in which said core is expanded intact by gas pressure, comprising the steps of:

welding at least two sheets of a metal alloy along intersecting weld lines to produce a core pack for expanding to produce said core;

at least some of said weld lines having gaps adjacent said intersections to allow passage of forming gas into cells formed by said weld lines for superplastic forming of said sheets to form said core;

whereby, placement of said gaps in said weld lines adjacent to said weld line intersections reduces stresses and material strain encountered around said weld gap during forming, thereby reducing tendencies of said core to rupture during forming.

20. A method as defined in claim 19, wherein:

a plurality of cross weld lines extend between adjacent intersecting weld lines spaced a certain distance apart; and both edges of said gaps lie within a portion of said cross weld lines that is 25% of said distance from one intersecting weld line to the opposite intersecting weld line.

* * * * *